US011259603B2

(12) United States Patent
Ressler

(10) Patent No.: US 11,259,603 B2
(45) Date of Patent: Mar. 1, 2022

(54) CORD AND WEBBING FASTENER AND ASSEMBLY

(71) Applicant: Dutch Clips LLC, Reinholds, PA (US)

(72) Inventor: Thomas Ressler, Reinholds, PA (US)

(73) Assignee: Dutch Clips LLC, Lancaster, PA (US)

( * ) Notice: Subject to any disclaimer, the term of this patent is extended or adjusted under 35 U.S.C. 154(b) by 0 days.

(21) Appl. No.: 17/081,333

(22) Filed: Oct. 27, 2020

(65) Prior Publication Data

US 2021/0161254 A1 Jun. 3, 2021

Related U.S. Application Data

(63) Continuation of application No. 15/690,715, filed on Aug. 30, 2017, now Pat. No. 10,835,001.

(60) Provisional application No. 62/381,358, filed on Aug. 30, 2016.

(51) Int. Cl.

| | |
|---|---|
| ***A44B 11/04*** | (2006.01) |
| ***A45F 3/24*** | (2006.01) |
| *A45F 3/26* | (2006.01) |

(52) U.S. Cl.

CPC ..... *A44B 11/04* (2013.01); *A45F 3/24* (2013.01); *A45F 3/26* (2013.01)

(58) Field of Classification Search

CPC ..... Y10T 24/4088; Y10T 24/4091; Y10T 24/4093; A44B 11/04; A45F 3/24

See application file for complete search history.

(56) References Cited

U.S. PATENT DOCUMENTS

| | | | | | |
|---|---|---|---|---|---|
| 905,880 | A * | 12/1908 | Jamison | F16G 11/10 | 24/130 |
| 1,034,222 | A * | 7/1912 | Dych | B63B 21/045 | 114/218 |
| 1,065,292 | A * | 6/1913 | Brown | A41F 11/02 | 2/335 |
| 1,523,041 | A * | 1/1925 | Simmons | A44C 5/22 | 24/320 |
| 1,936,127 | A * | 11/1933 | Dunlevy | A41F 15/002 | 24/312 |
| 2,224,773 | A * | 12/1940 | Shaulson | A44B 11/28 | 24/200 |
| 2,269,696 | A * | 1/1942 | Shaulson | A41F 11/02 | 24/200 |
| 2,276,595 | A * | 3/1942 | Shaulson | A44B 11/04 | 24/200 |
| 2,278,153 | A * | 3/1942 | Shaulson | A44B 11/04 | 24/200 |
| 2,285,714 | A * | 6/1942 | Hirsh | A44B 11/04 | 24/199 |
| 2,293,562 | A * | 8/1942 | Rosenthal | A44B 11/04 | 24/200 |
| 2,473,209 | A * | 6/1949 | Lombardi | A44B 11/04 | 24/321 |

(Continued)

*Primary Examiner* — Jason W San

(74) *Attorney, Agent, or Firm* — Barley Snyder

(57) ABSTRACT

A cord and webbing fastener is provided. The fastener includes a body, an elongated, oval-shaped passageway extending there through from lateral sides thereof and between a mid-bar and a bottom bar, and a jawed passageway extending there through from lateral sides thereof and between the mid-bar and the first jaw and the second jaw. The fastener is used assembled with cord and webbing to adjustably secure a hammock or other load to a support or anchor point.

14 Claims, 13 Drawing Sheets

(56) References Cited

U.S. PATENT DOCUMENTS 2,529,308 A * 11/1950 Powers ..... A41F 15/02 24/198
2,565,629 A * 8/1951 Reinberger ..... A44B 11/04 24/200
2,613,420 A * 10/1952 Brown ..... A44B 11/04 24/200
2,643,431 A * 6/1953 Schwarz ..... A41F 15/002 24/200
2,901,801 A * 9/1959 Girodet ..... A44B 19/403 24/200
2,981,990 A * 5/1961 Balderree, Jr. .... B65D 33/1625 24/30.5 R
3,066,374 A * 12/1962 Garson ..... A41F 15/002 24/198
3,075,268 A * 1/1963 Schwartz ..... A41F 15/002 24/200
3,112,750 A * 12/1963 Jonas ..... A41F 15/002 450/86
3,161,931 A * 12/1964 Zif ..... A41F 1/006 24/200
3,222,687 A * 12/1965 Rosenzweig ..... A41F 15/002 2/323
3,222,688 A * 12/1965 Rosenzweig ..... A41F 15/002 2/323
3,529,329 A * 9/1970 Burleson ..... A41F 11/02 24/200
4,571,783 A * 2/1986 Kasai ..... A44B 11/04 24/200
5,063,641 A * 11/1991 Chuan ..... A44B 11/18 24/197
6,056,625 A * 5/2000 Fildan ..... A41F 15/002 2/336
8,568,190 B2 * 10/2013 Nelson ..... A63H 27/10 446/220
9,003,579 B1 * 4/2015 Pinholster, Jr ..... A45F 3/24 5/120
D781,745 S * 3/2017 Ressler ..... D11/218
D817,225 S * 5/2018 Ressler ..... D11/218
10,653,211 B2 * 5/2020 Ressler ..... A44B 11/02
10,704,648 B2 * 7/2020 Ressler ..... F16G 11/12
2003/0145435 A1 * 8/2003 Carver ..... A44B 11/04 24/115 F
2004/0160098 A1 * 8/2004 Lyons ..... A47C 3/0255 297/281
2004/0226147 A1 * 11/2004 Fildan ..... A44B 11/04 24/302
2005/0251910 A1 * 11/2005 Boyd ..... A45F 3/22 5/120
2006/0242803 A1 * 11/2006 Drake ..... A44B 11/04 24/324
2008/0078024 A1 * 4/2008 Weir ..... A45F 3/24 5/128
2008/0184533 A1 * 8/2008 Kelly ..... B60D 1/18 24/129 R
2009/0055999 A1 * 3/2009 Garcia ..... A44B 11/04 2/421
2009/0282653 A1 * 11/2009 Yang ..... A43C 7/00 24/129 R
2014/0140784 A1 * 5/2014 Vick ..... A44B 11/04 410/97
2014/0325804 A1 * 11/2014 Hortnagl ..... A44B 11/263 24/592.1
2015/0067951 A1 * 3/2015 Johnsen ..... A63B 33/002 2/431
2015/0237938 A1 * 8/2015 O'Neill ..... B60P 7/0823 2/322
2015/0237983 A1 8/2015 O-Neill
2015/0272281 A1 * 10/2015 Xiao ..... A44B 11/16 297/468
2017/0049191 A1 * 2/2017 Prugue ..... A44B 11/04
2017/0202344 A1 * 7/2017 Ressler ..... A45F 3/22
2018/0070682 A1 * 3/2018 Ressler ..... A45F 3/24
2018/0140056 A1 * 5/2018 Ressler ..... A44B 11/18
2019/0029329 A1 * 1/2019 Zhang ..... A44B 11/04
2019/0093384 A1 * 3/2019 Leitgeb ..... E04H 15/42
2020/0158207 A1 * 5/2020 Ressler ..... F16G 11/14

* cited by examiner

CORD AND WEBBING FASTENER AND ASSEMBLY

CROSS-REFERENCE TO RELATED APPLICATIONS

This application claims the benefit of the filing date under 35 U.S.C. § 119(a)-(d) of U.S. patent application Ser. No. 15/690,715, filed Aug. 30, 2017, which claims priority to U.S. Provisional Application No. 62/381,358, filed Aug. 30, 2016.

FIELD OF THE INVENTION

This invention relates to a cord and webbing fastener to suspend loads and, more particularly, to fastener and assembly using the same to suspend hammocks.

BACKGROUND

Tools for securing loads are of interest in many applications. In particular, there is a need for a tool to quickly set, maintain, adjust, or release tension in webbing and cordage used for camping equipment, such as for hammocks, backpacks, tarpaulins (tarps), flys, tents and similar shelters, or other structures.

While tools to set, maintain, adjust, and release tension in strapping and lines are known, these known tools are generally bulky, weighty, and cumbersome, and often include various catches, eyes, cleats, grips, pulleys, and the like, which require multiple knots to function. Cleats and grips can abrade or damage strapping and other tie materials used to suspend loads.

In particular, a simple and lightweight tool to fasten a hammock in place is desirable.

SUMMARY

In light of the shortcomings of the prior art and to solve a long felt need, a cord and webbing fastener and an assembly using the cord and webbing fastener are provided.

A cord and webbing fastener having a distal end and a proximal end and comprising a bottom bar positioned along the distal end thereof; a mid-bar positioned substantially parallel to the bottom bar; a first jaw and a second jaw positioned along the proximal end thereof and substantially parallel to the mid-bar; a first joining element connecting a first end of the first jaw, a first end of the mid-bar, and a first end of the bottom bar; and a second joining element connecting a first end of the second jaw, a second end of the mid-bar, and a second end of the bottom bar to provide 1) an elongated, oval-shaped passageway in the distal end extending through the cord and webbing fastener from lateral sides thereof and between the mid-bar and the bottom bar and sized to receive a flexible webbing; and 2) a jawed passageway in the proximal end extending through the cord and webbing fastener from lateral sides thereof and between the generally parallel mid-bar and the first jaw and the second jaw, the jawed passageway having a gap between the second end of the first jaw and the first end of the second jaw.

The jawed passageway is sized to receive webbing, wherein webbing is threaded through the jawed passageway in a first direction, looped around the mid-bar, and then threaded in a second direction through the elongated, oval-shaped passageway.

A further embodiment of the invention is a cord and webbing fastener assembly. The assembly includes the cord and webbing fastener and webbing and cordage sized to be used with the cord and webbing fastener as described herein to anchor or secure a load.

A further embodiment of the invention is a kit including cord and webbing fasteners and a plurality of tie materials sized to be used with the cord and webbing fastener as described herein to anchor or secure a load.

BRIEF DESCRIPTION OF THE DRAWINGS

The invention will now be described by way of example with reference to the accompanying figures, wherein like reference numerals designate like structural elements. And in which.

DETAILED DESCRIPTION OF THE EMBODIMENT(S)

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

Figure 1:
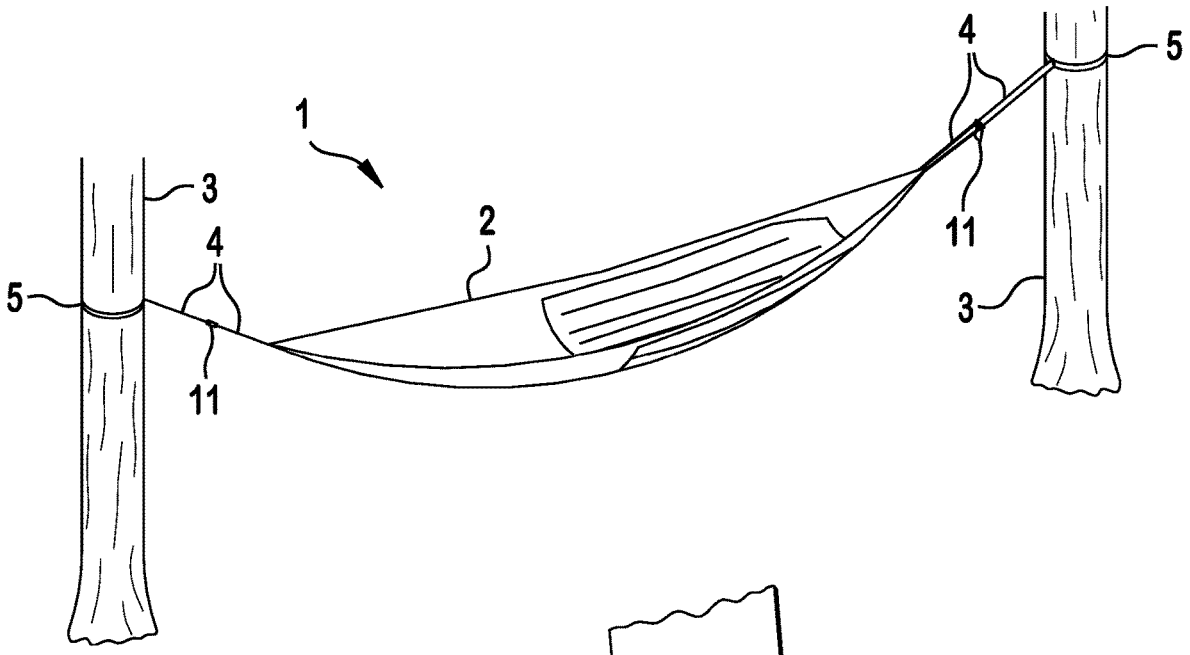
FIG. 1 shows a perspective view of a cord and webbing fastener according to the invention, shown in use to suspend a known hammock.
Figure 2:
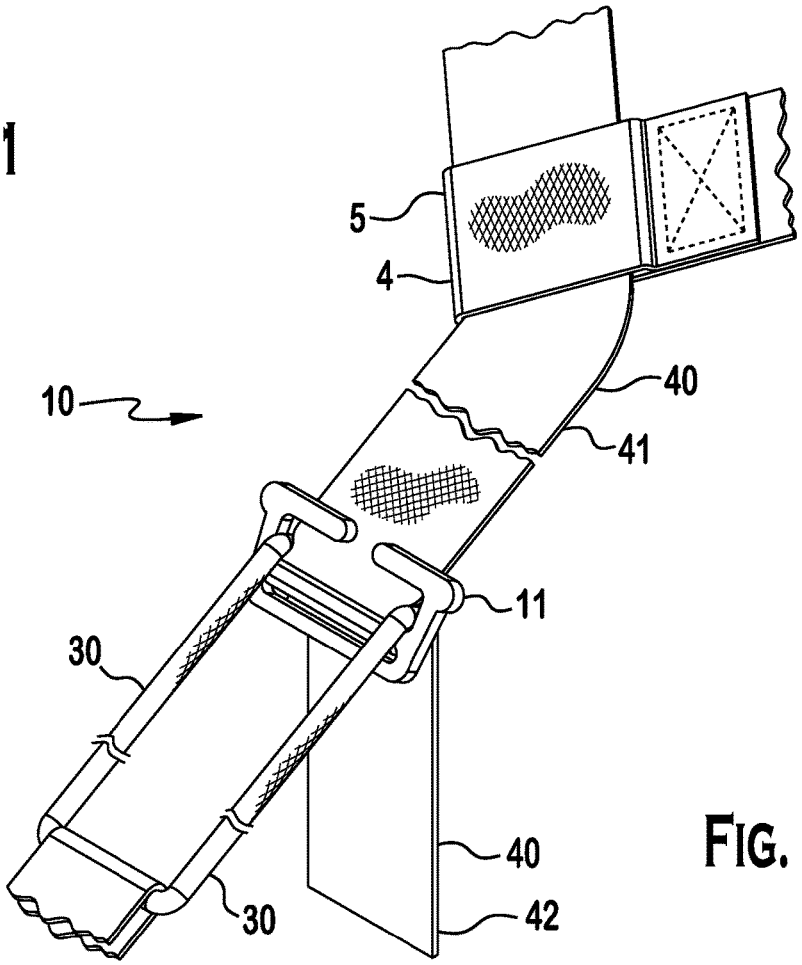
FIG. 2 is a perspective view of the cord and webbing fastener assembly according to the invention in use, shown assembled with a cord and webbing fastener, webbing, and cordage.
Figure 3:
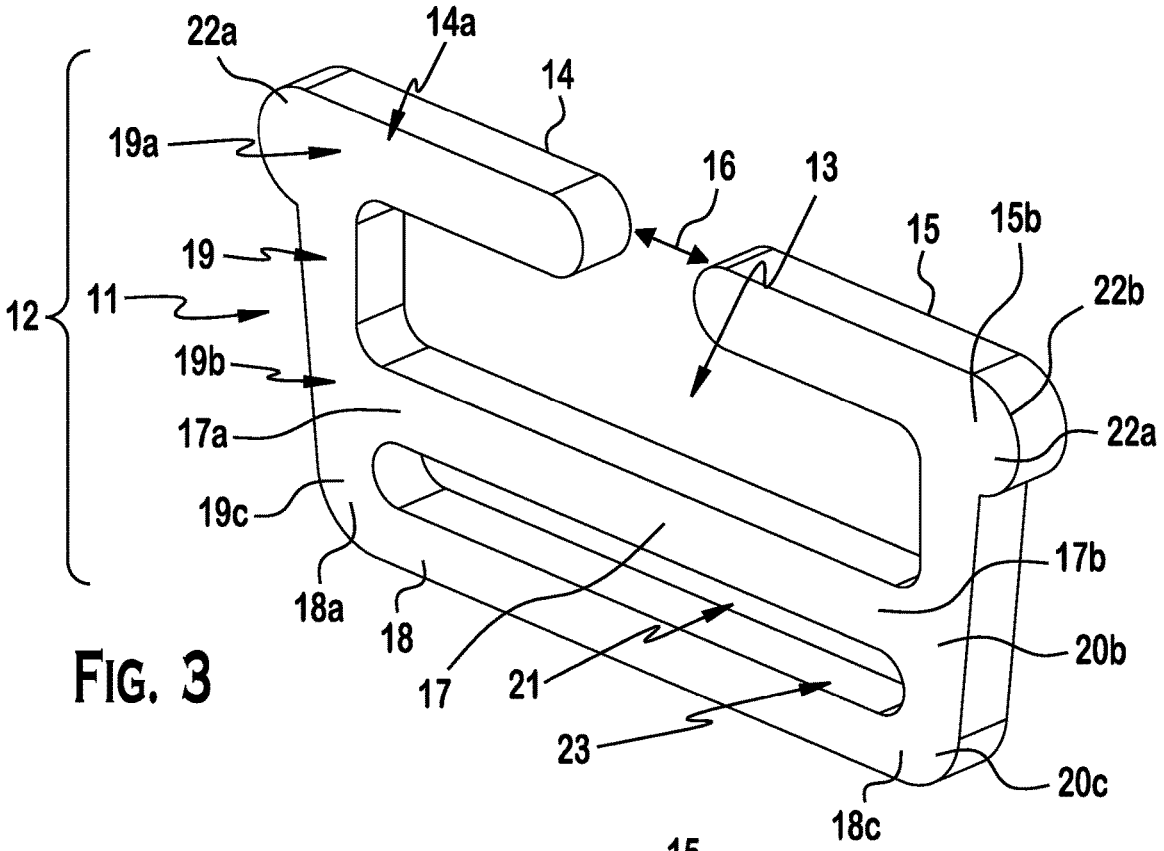
FIG. 3 is a left side top perspective view of the cord and webbing fastener.
Figure 4:
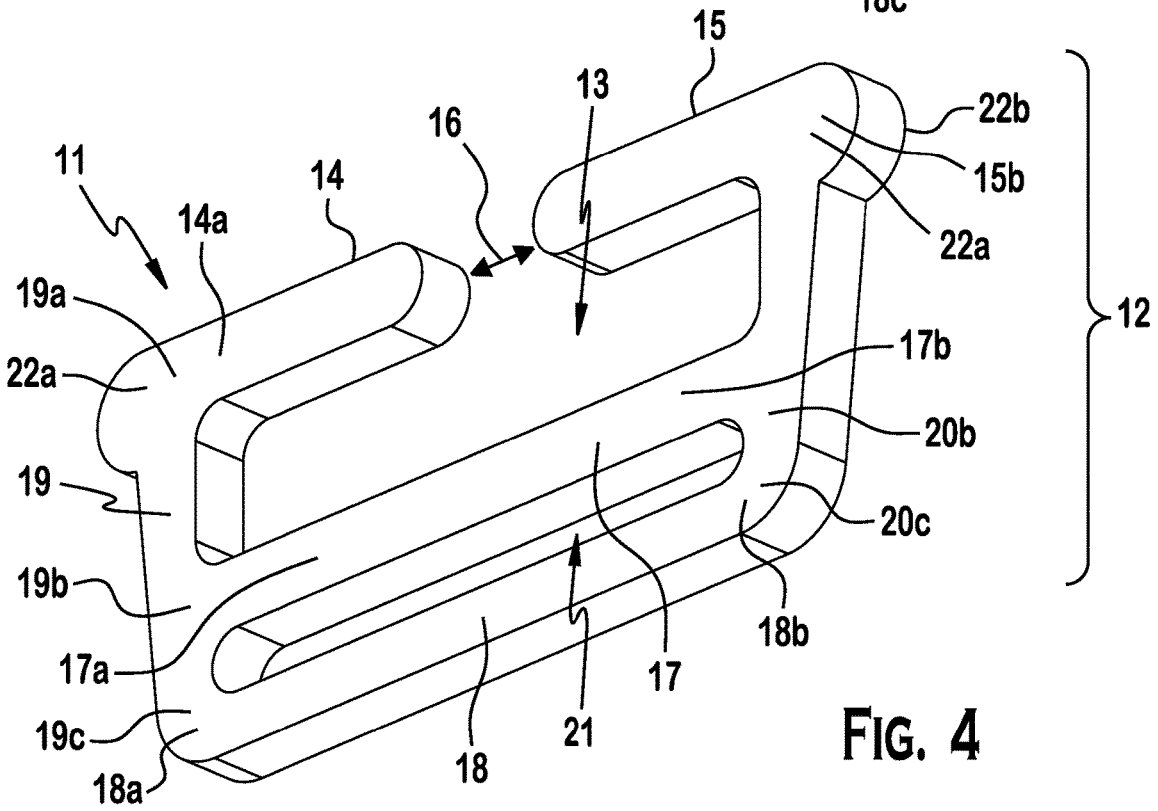
FIG. 4 is another perspective view of the cord and webbing fastener of FIG. 3.
Figure 5:
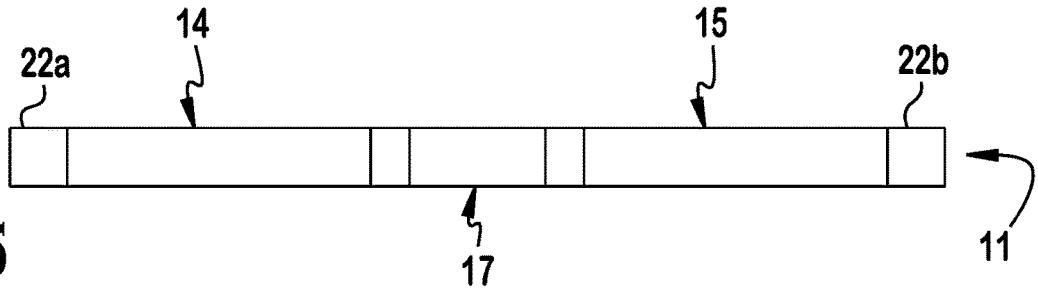
FIG. 5 is a top plan view of the cord and webbing fastener of FIG. 3.
Figure 6:
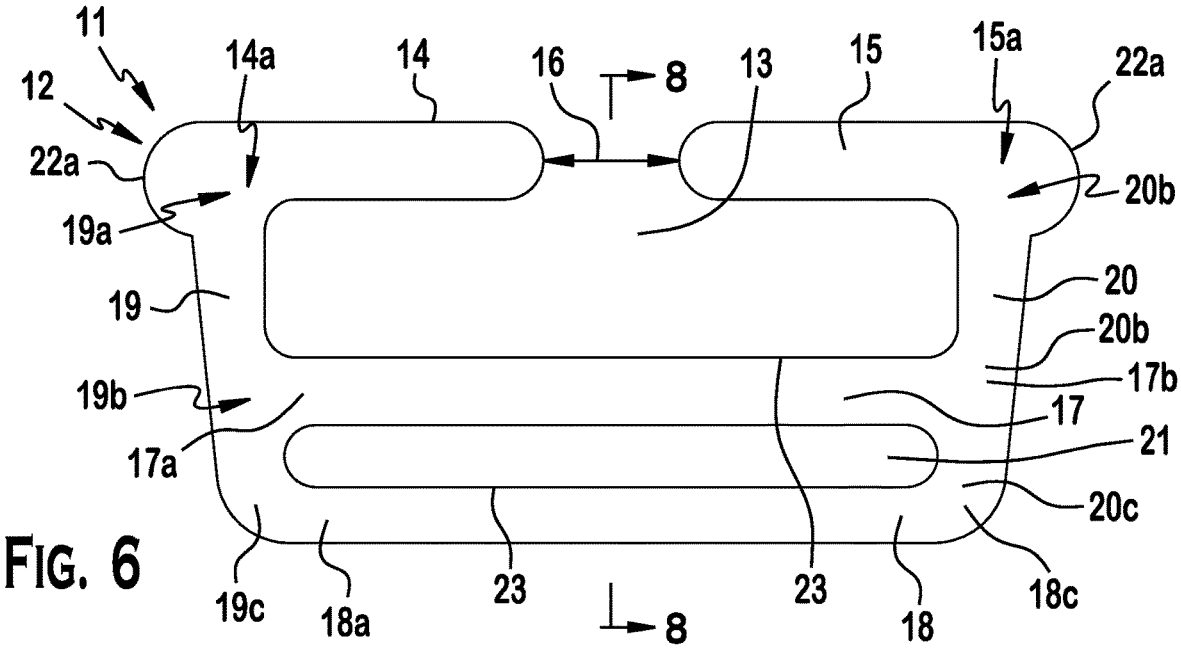
FIG. 6 is a side plan view of the cord and webbing fastener of FIG. 3.
Figure 7:
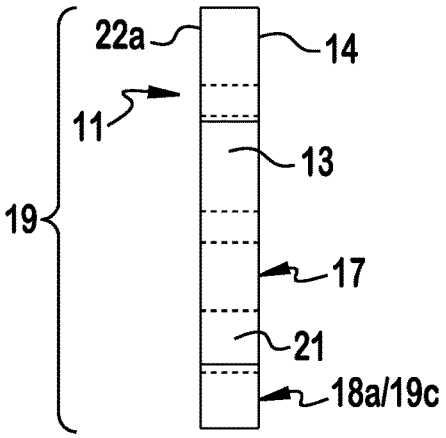
FIG. 7 is a side view of the cord and webbing fastener of FIG. 6.
Figure 8:
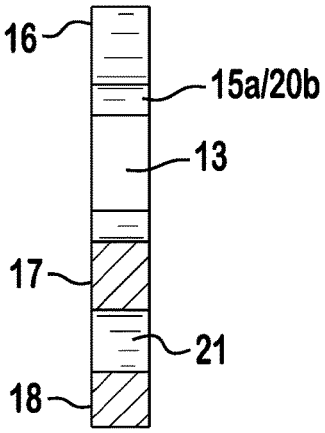
FIG. 8 is a cross-sectional view of the cord and webbing fastener along line 8-8 of FIG. 6.
Figure 9:
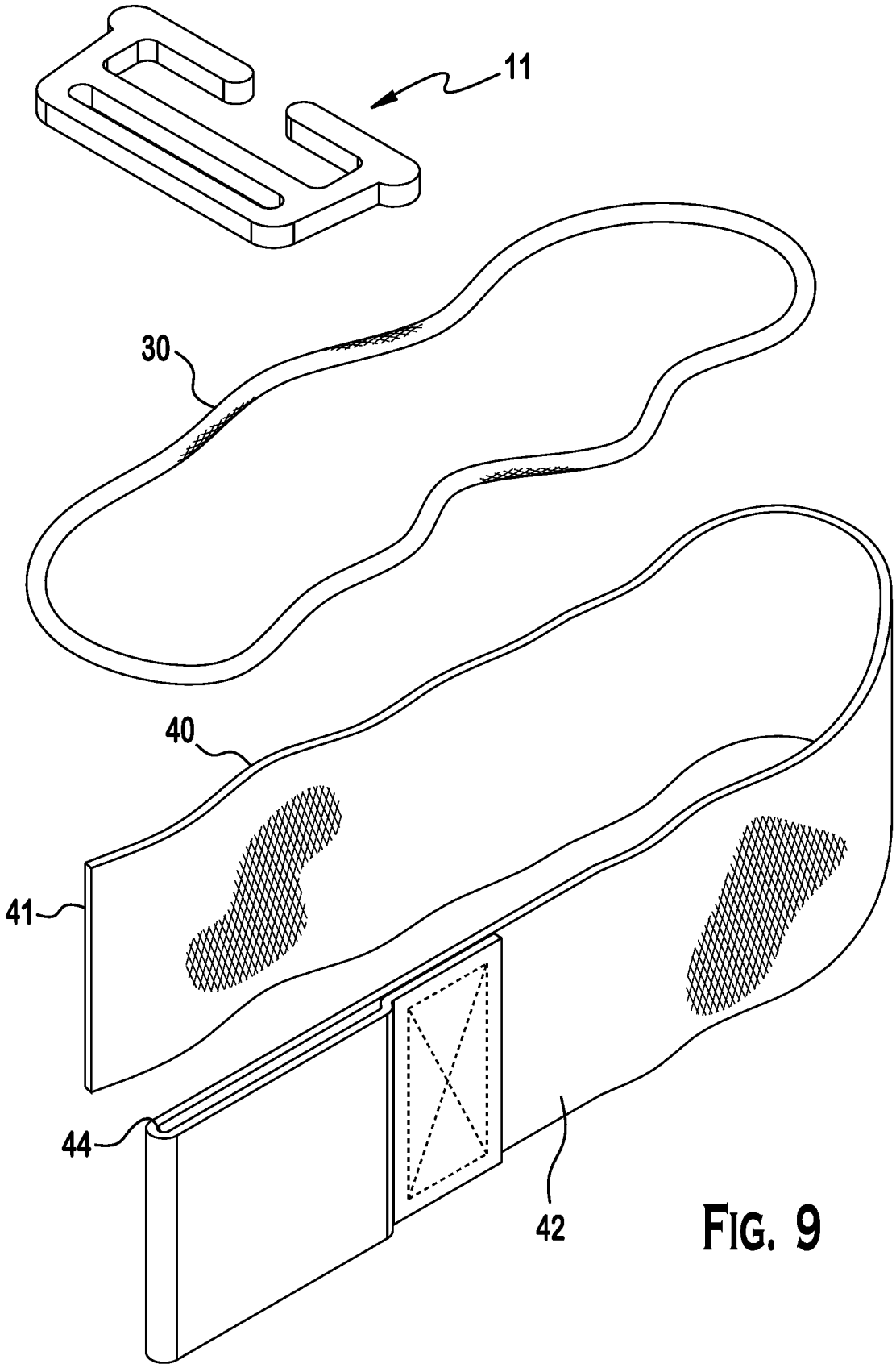
FIG. 9 is an exploded perspective view of the components of the cord and webbing fastener assembly, i.e., the cord and webbing fastener, cordage, and webbing.

With reference to FIG. 1, a cord and webbing fastener assembly 10 according to an exemplary embodiment is shown in use and is referred to generally by reference numeral 1.

As shown in FIGS. 1-25, the cord and webbing fastener assembly 10 generally includes the following major components: a cord and webbing fastener 11 (herein after referred to as a "fastener"), a cord 30, and a webbing 40.

As shown in FIG. 1, when assembled and installed, the cord and webbing fastener assembly holds a hammock 2 or other load in a desired position. FIGS. 2-25 feature elements of the cord and webbing fastener assembly useful in all embodiments, for securing a weight or load. The weight or load may be suspended from one or more supports 3 or anchor points.

As shown in FIGS. 2-25, the fastener 11 is a shaped article having a rectangular cross section and two major planar surfaces position opposite and generally parallel to each other. The fastener 11 includes a body 12, a jawed passageway 13, a first jaw 14, a second jaw 15, a mid-bar 17, and a bottom bar 18, a first joining element 19, and second joining element 20, and an elongated, oval-shaped passageway 21. The first joining element 19 is joined to intersect at a proximal end 19*a* with the first jaw14 at a first end 14*a* and is also joined to intersect at a mid-point 19*b* with the mid-bar 17 at a first end 17*a*, and is also joined to intersect at a distal end 19*c* with the bottom bar 18 at a first end 18*a*. The second joining element 20 is joined to intersect at a proximal end 20*a* with the second jaw 15 at a first end 15*b*, and is also joined to intersect at a mid-point 20*b* with the mid-bar 17 at a second end 17*b*, and is also joined to intersect at a distal end 20*c* with the bottom bar 18 at a second end 18*c*. So joined, the first jaw 14, the second jaw 15, the mid-bar 17, the first joining element 19, and the second joining element 20 together form the jawed passageway 13. Additionally, so joined, the mid-bar 17, the bottom bar 18, the first joining element 19, and the second joining element 20 together form the elongated, oval-shaped passageway 21.

As used herein, the "jawed passageway" describes a hollow receiving passageway having straight sides and extending from lateral sides of the fastener body 12 there through, the jawed passageway having cross sections that are shaped like a rectangle and sized to allow the threading of webbing, the jawed passageway 13 also having a gap 16 between the un-joined ends of the first jaw 14 and the second jaw 15 that is sized to allow the passage of cordage. The jawed passageway 13 has internal corners that are preferably softened from a 90° angle.

As used herein, an "elongated, oval-shaped passageway" describes a hollow receiving passageway having straight sides and extending from lateral sides of the fastener body 12 there through, and having cross sections that are shaped like a flattened circle that is longer than it is wide and sized to allow the threading of webbing. The elongated, oval-shaped passageway 21 has internal corners that are preferably softened from a 90° angle. A first grip projection 22*a* is located at the intersection of the first joining element 19 with a first end 14*a* of the first jaw 14. A second grip projection 22*b* is located at the intersection of the second joining element 20 with a second end 15*b* of the second jaw 15.

In the shown embodiment, the edges 23 of the fastener body 12 are preferably beveled or softened from a 90° angle along a perimeter thereof and, more particularly, at the perimeter of the jawed passageway 13 and the elongated, oval-shaped passageway 21 in order to avoid wear or abrasion of the webbing 40 or cord 30 passing over the edge 23.

One of ordinary skill in the art would appreciate that other design options are possible without departing from the spirit of the invention.

In the shown embodiments, the fastener body 12 is made of a rigid material, such as titanium, aluminum, steel, or plastic. Preferably, the fastener body 12 is made from titanium or aluminum. In the shown embodiment, the fastener body 12 is a solid, monolithic piece of material. However, one of ordinary skill in the art would appreciate that the fastener body 12 may be prepared from a variety of structural materials including an alloy of metals, a polymer, a composite, or other compatible and suitable material known in the art. The choice of the solid structural material is influenced by the material's weight, durability, cost, and the load it will be supporting. Further, one of ordinary skill in the art would appreciate that the fastener body 12 may be hollow.

The fastener body 12 is manufactured through machining, but could be manufactured using casting, stamping, or through another method known to one of ordinary skill in the art and consistent with the chosen material to achieve the desired strength for the intended use. For example, the fastener body 12 may be made of polymer using injection molding.

In an exemplary embodiment, the fastener 11 is sized to be used with tie material 4 (i.e., webbing and cord) as is described below. In one embodiment of this element according to the invention, the fastener's elongated, oval-shaped passageway 21 is sized laterally to be threaded with a one-inch wide webbing. The fastener's jawed passageway 13 is sized laterally to be threaded with a one-inch wide webbing and additionally sized to accommodate a cord as described below. Furthermore, it is expected that the fastener 11 may be scaled larger or smaller to accept webbing or cordage of different dimensions for use in different applications. The operation of such relatively larger or smaller fasteners 11 will be the same regardless of the specific application.

The cord 30 and webbing 40 suitable for use with the fastener 11 are known to those of ordinary skill in the art and are selected to possess characteristics of strength and durability suitable for the tension and weight to be secured. The cord and the webbing are made of various materials including woven, braided, or twisted nylon or other plastic polymer, natural fibers, such as hemp or silk, and other such material used by those of skill in the art to secure weights or loads. Preferably, tie materials selected to use with the fastener are characterized by extremely low stretch, abrasion resistance, light resistance, high strength, and highly durability and are light in weight. The tie materials selected to use with fastener may be made of an ultra-high molecular weight polyethylene (UHMwPE) fiber. This type of fiber is alternatively referred to as high-modulus polyethylene (HMPE) and high-performance polyethylene (HPPE). This type of line features light weight, high strength, high durability, and has a surface texture conducive to maintaining a tension suitable for securing a hammock 2 or other load. One commercially available fiber suitable for use with the fastener is Dyneema®. However, such high performance webbing or cord is not required as the fastener may be used with any material that is appropriate for the weight to be secured and the particular embodiment of the invention. An alternative choice of fiber for tie materials is a lightweight nylon kernmantle rope, also referred to as parachute cord. A further alternative choice of fiber can be a monofilament line. The tie materials are sized to meet the use and dimensions of the two-part cord and webbing device.

"Webbing" refers generally herein to a flexible, linear element such as webbing, strap, or ribbon. The webbing 40 has a substantially rectangular cross-section; its width is substantially greater than its height and its overall dimensions and material properties are suitable for the weight to be secured and conditions of use. The webbing is preferably constructed of any suitable material that has extremely low stretch and high abrasion resistance, preferably polypropylene, polyester, or nylon. More preferably, the webbing has extremely low stretch, abrasion resistance, light resistance, high strength, and highly durability and is light in weight. The webbing, typically 1 inch wide, is chosen to fit the dimensions of the fastener 11.

"Cord" refers generally herein to a flexible, linear element such as a cord, cable, line, rope, string, or twine. The cord 30 has a substantially circular cross-section and its diameter, length, and material properties are selected to be suitable for the weight to be secured and conditions of use. The cord is preferably constructed of any suitable material that has extremely low stretch and high abrasion resistance, preferably polypropylene, polyester, or nylon. More preferably, the cord has extremely low stretch, abrasion resistance, light resistance, high strength, and highly durability and is light in weight. The cord is preferably made of an extremely low-stretch/non-elastic continuous loop of cordage. One choice for this element is AmsteelBlue®-Blue in diameters of 7/64 inch (average strength 1600 lbs. breaking strength) or 1/8 inch (average strength 2500 lbs. breaking strength), a torque-free, 12-strand single with a high strength-to-weight ratio and, size-for-size, possessing essentially the same strength as steel and with superior flex fatigue and wear resistance. In an exemplary embodiment, the fastener 11 is sized for 7/64 inch to 1/8 inch static (non-stretch) cord, but is not limited for use with any specific sized tie material. In applications of the cord and webbing fastener assembly, a user should not attempt to secure a load heavier than what the chosen tie material can support.

Referring back to FIG. 1, the use of the cord and webbing fastener assembly will be described. As shown in FIG. 1, the hammock 2 is suspended between supports 3 using the cord and webbing fastener assembly.

The cord and fastener assembly is generally used to maintain tension on tie material 4 that restrain a hammock 2 or other load in a substantially linear orientation relative to a longitudinal axis between two supports 3. The cord and webbing fastener assembly 10 may also be used to support a load from at least a single point. As shown in FIG. 1, to use the invention, a site is selected that will allow for the cord and webbing fastener assembly 10 to suspend a hammock 2 between supports 3 at a desirable height. The selected site offers a spatial arrangement that provides a substantially unobstructed space in which to set a hammock 2 to a desired length and tension and at a desired height above the ground. In the illustrated embodiment of FIG. 1, the supports 3 are living trees. It is preferable that living trees are at least 8 inches in diameter or adjudged to be sufficiently strong to bear the weight of the load to be suspended. Alternative structures or points from which to suspend the hammock 2 include structurally strong living and dead tree branches and trunks, boulders, rock faces, flag or light poles, wall rafters, railings, beams, and other points that can support a weight of several hundred pounds without a structural failure. A support may be vertical to the ground, such as a tree, post, or similar element. Alternatively, a support may be horizontal relative to the ground, such as a branch or a stationary railing. Also, a support may include hardware attached to a vertical or horizontal support.

Webbing 40 is secured at a first end 41 about the support by means of knots or, preferably, a loop 44 formed in a first end 41 of the webbing 40. Such looped webbing straps 5 are known as "tree huggers" or "tree straps" and help reduce abrasion or damage to the tree surface from the suspended weight or load. Typically, the webbing 40 has a final loop 44 jkjin its first end 41 that is secured by stitching or other attachment method. The lengths of webbing 40 are sized to adequately encircle a tree and support the hammock 2 or other load. Additional accessory materials (i.e., tubing, padding) may also be used to maintain the strap in position and to distribute the pressure and load placed by the hammock 2 on the support.

Figure 10:
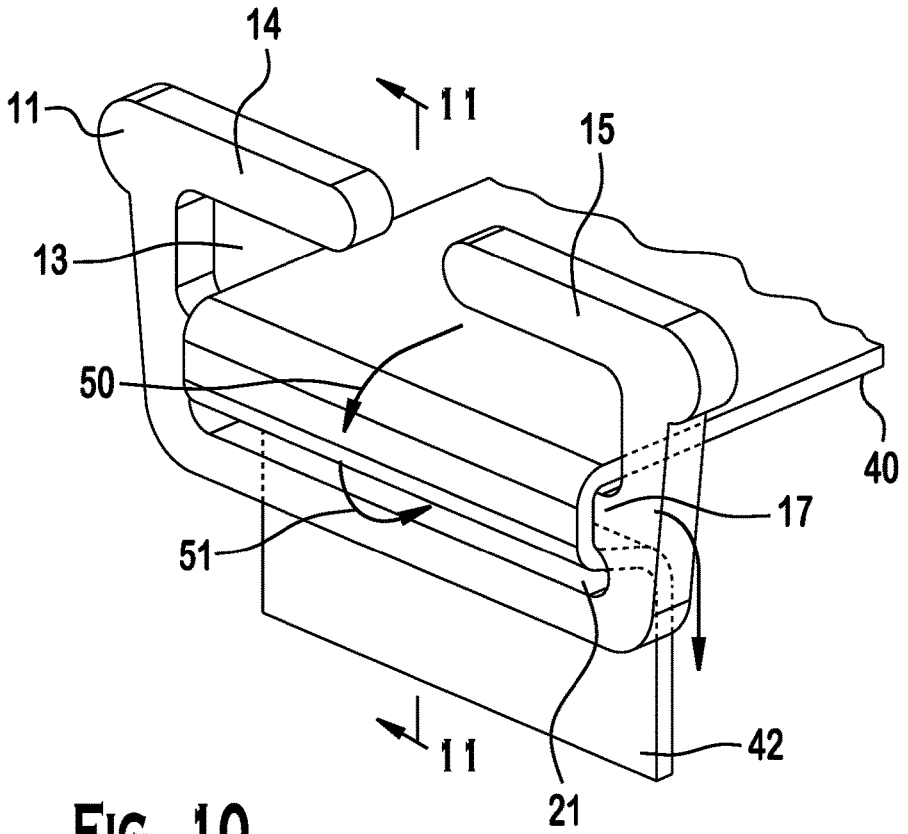
FIG. 10 is a perspective view showing a first step in assembling the cord and webbing fastener and webbing.
Figure 11:
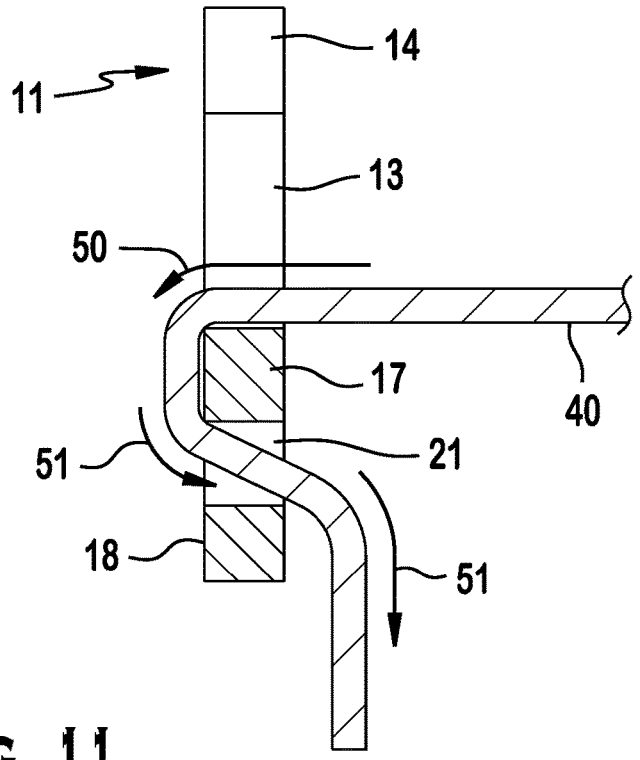
FIG. 11 is a cross section view along a center axis line 11-11 of FIG. 10 showing the assembled cord and webbing fastener and webbing thereof.
Figure 12:
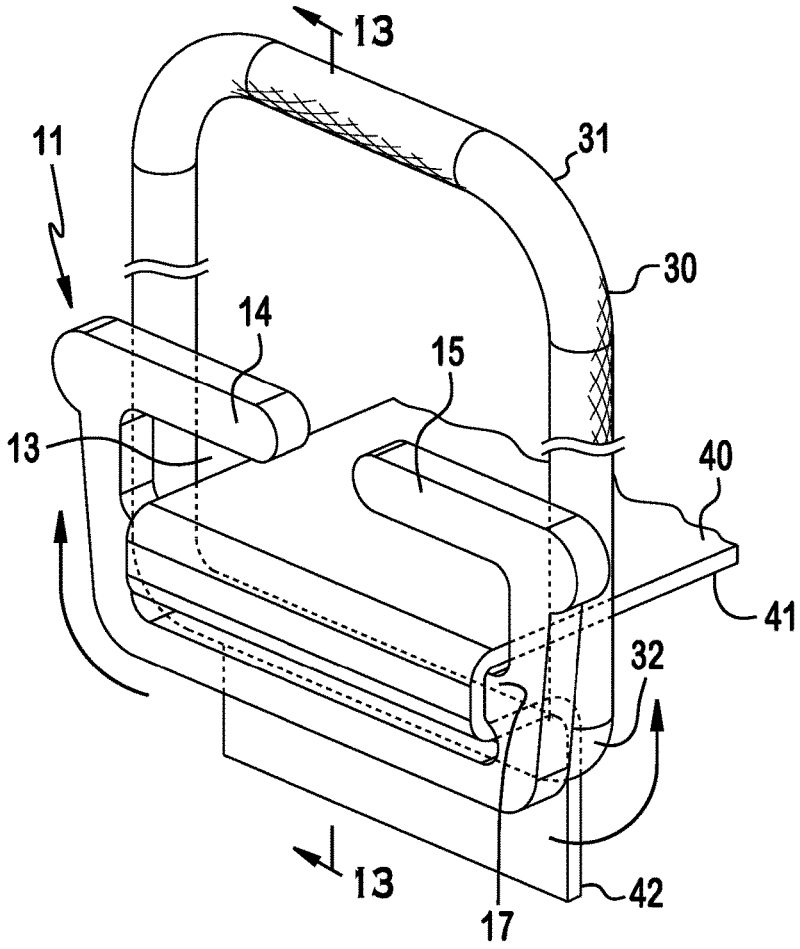
FIG. 12 is a perspective view showing a second step in assembling the cord and webbing fastener, webbing, and cordage, i.e., looping the cordage onto the cord and web-webbing assembly.
Figure 13:
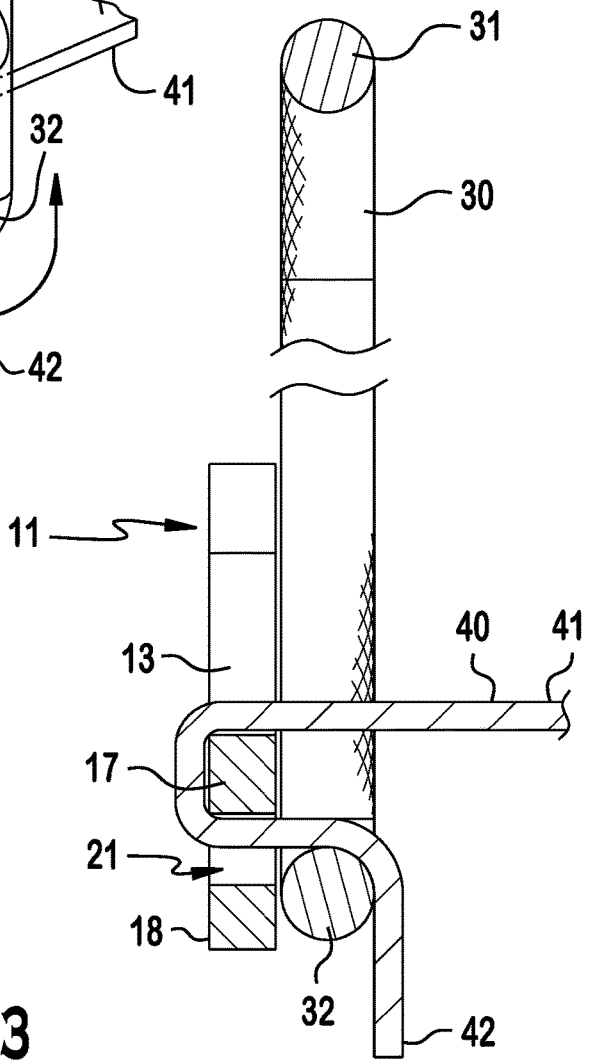
FIG. 13 is a cross section view along a center axis line 13-13 of FIG. 12 showing the assembled cord and webbing fastener, webbing, and cordage thereof.

In a first step as shown particularly in FIGS. 10 and 11, the fastener 11 is threaded with a second end 42 of webbing 40 in a first direction 50 through the jawed passageway 13 and then through the oval-shaped passageway 21 in the opposite (second) direction 51, creating a loop of webbing 40 around the mid-bar 17 of the fastener 11.

In a second step as shown in FIGS. 2, 12-25 (particularly in FIGS. 12-13), a continuous cord 30 is positioned around the webbing 40 on the side of the fastener 11 adjacent to the first and second ends 41, 42 of the webbing 40 and on the opposite side of the fastener 11 from the loop of webbing about the mid-bar 17. As shown in FIGS. 2, 12-25 (particularly FIGS. 14-15), the cord 30 has a first loop 31 and a second loop 32. The cord 30 is secured (not shown) to a hammock 2 or other load at first loop 31 by various methods known to those of ordinary skill in the art. Alternatively, the cord 30 may be discontinuous and have a formed loop in place of the second loop. One of ordinary skill in the art would appreciate that the shape, size, and material of the hammock 2 can be modified and designed for a particular use.

Figure 14:
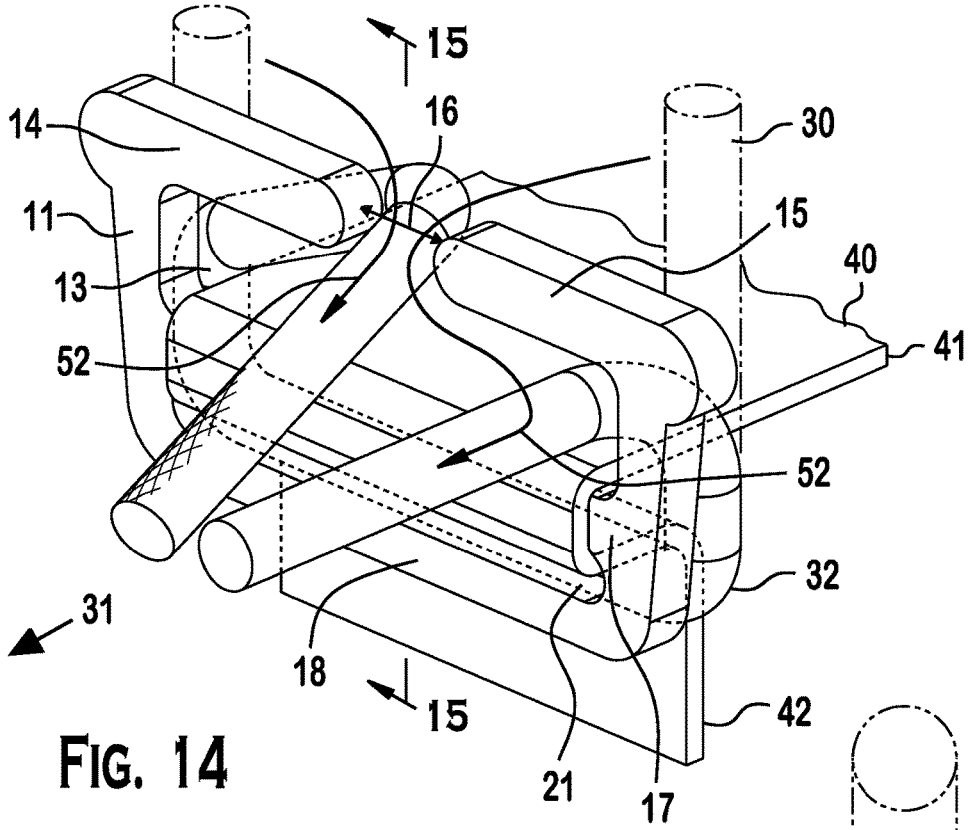
FIG. 14 is a perspective view of showing a third step in assembling the cord and webbing fastener, webbing, and cordage, i.e., engaging the cordage within the cord and webbing fastener.
Figure 15:
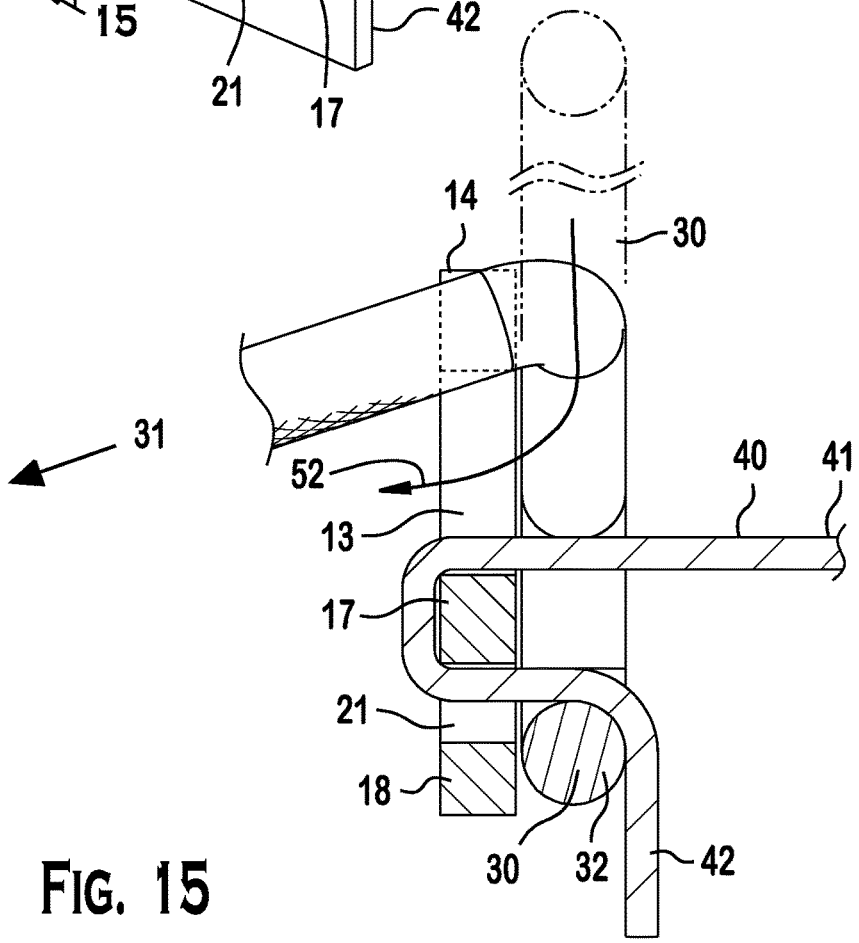
FIG. 15 is a cross section view along a center axis line 15-15 of FIG. 12 showing the assembled cord and webbing fastener, webbing, and cordage thereof.

In a third step as shown in FIGS. 14-15, the cord 30 is pulled in a third direction 52 such that the cord 30 passes through the gap 16 between the first jaw 14 and the second jaw 15 into the jawed passageway 13 on the opposite side of the fastener 11 from the first and second ends 41, 42 of the webbing. In this manner, the first jaw 14 and the second jaw 15 are engaged with the cord.

Figure 16:
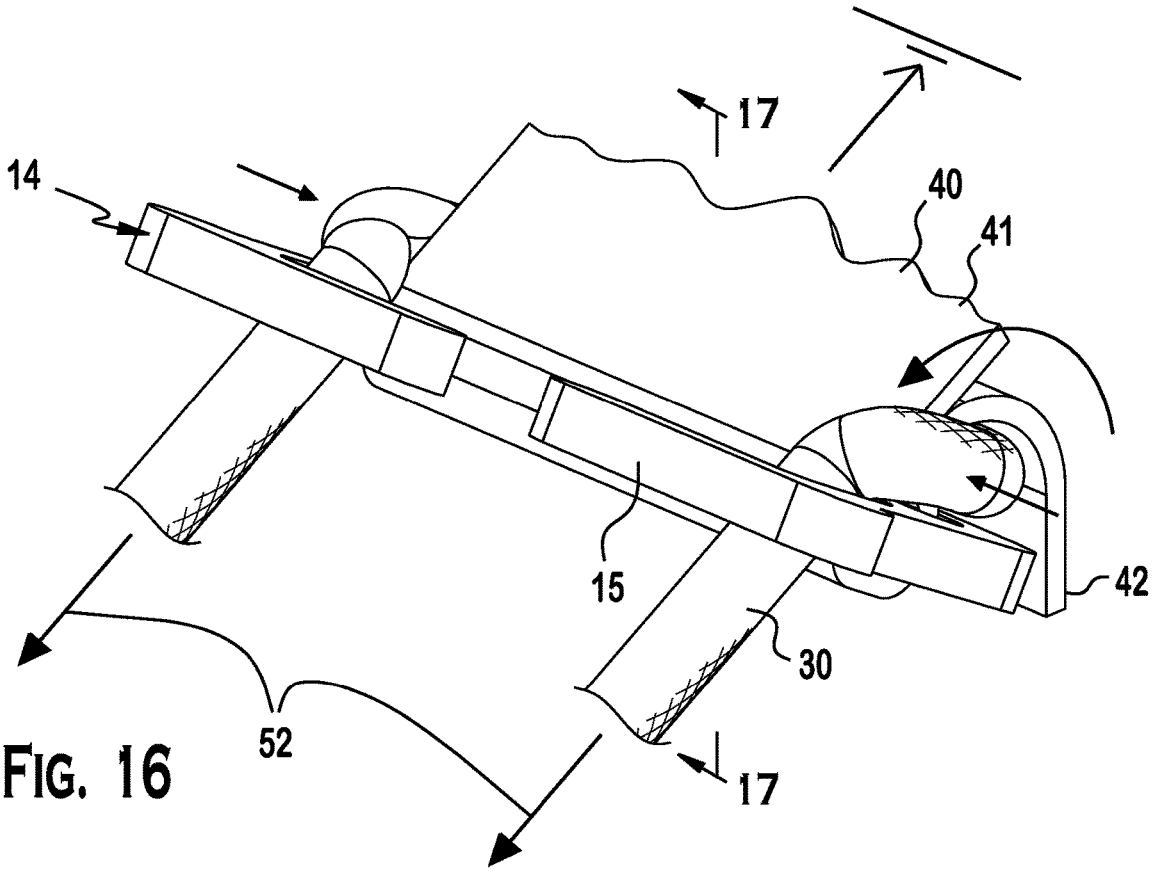
FIG. 16 is a perspective view of showing a fourth step in assembling the cord and webbing fastener, webbing, and cordage, i.e., showing an initial rotation of the cord and webbing fastener.
Figure 17:
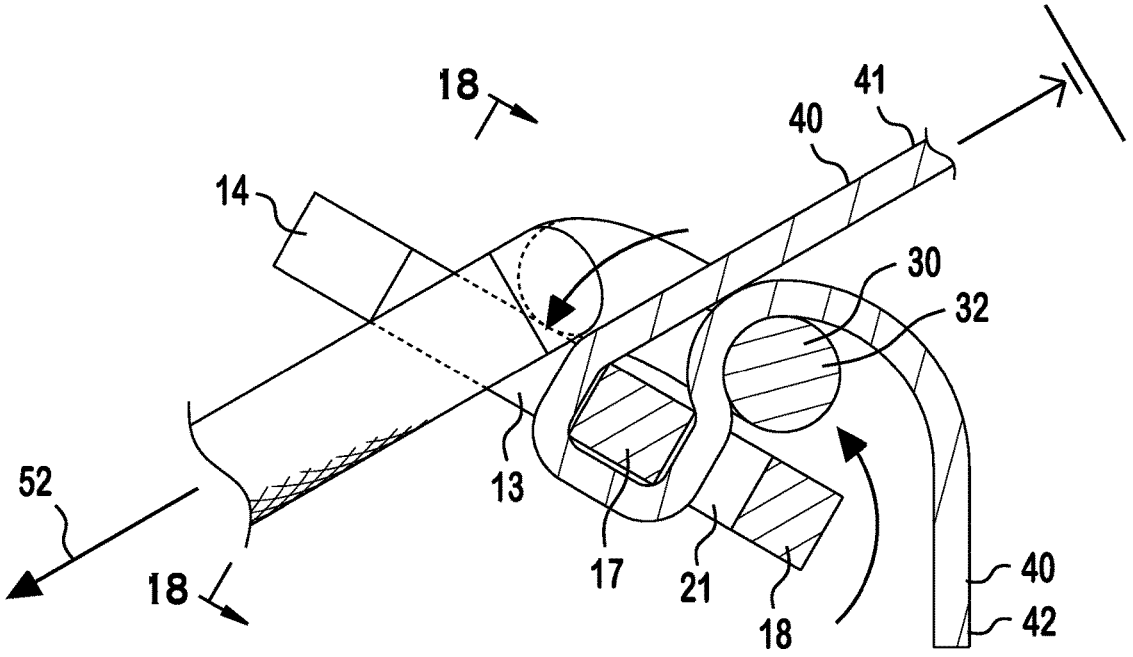
FIG. 17 is a cross section view along a line 17-17 of FIG. 16 showing the assembled cord and webbing fastener, webbing, and cordage thereof.

In a fourth step, as shown in FIGS. 16-17, the tension placed on the cord 30 as it is pulled in the third direction 52 rotates the fastener 11 and draws the cord 30 up against the webbing 40 creating a friction stop.

Figure 18:
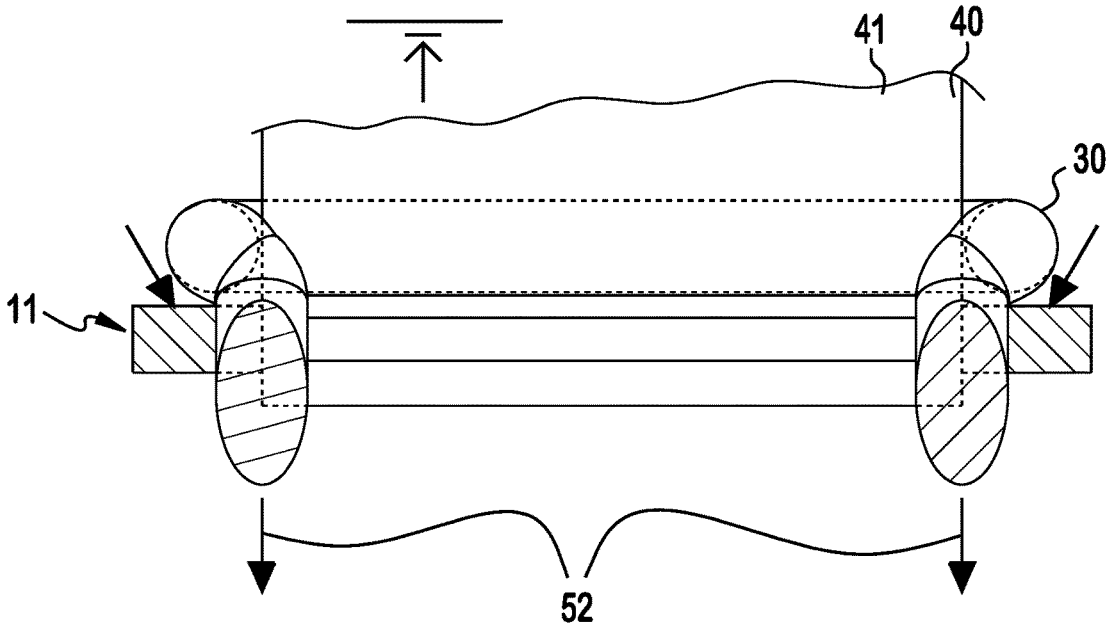
FIG. 18 is a cross section view along a line 18-18 of FIG. 17 showing the assembled cord and webbing fastener, webbing, and cordage thereof, i.e., showing the cordage wider than the width of the webbing.

In FIG. 18, the cord 30 around the webbing 40 is wider than the jawed passageway 13.

Figure 19:
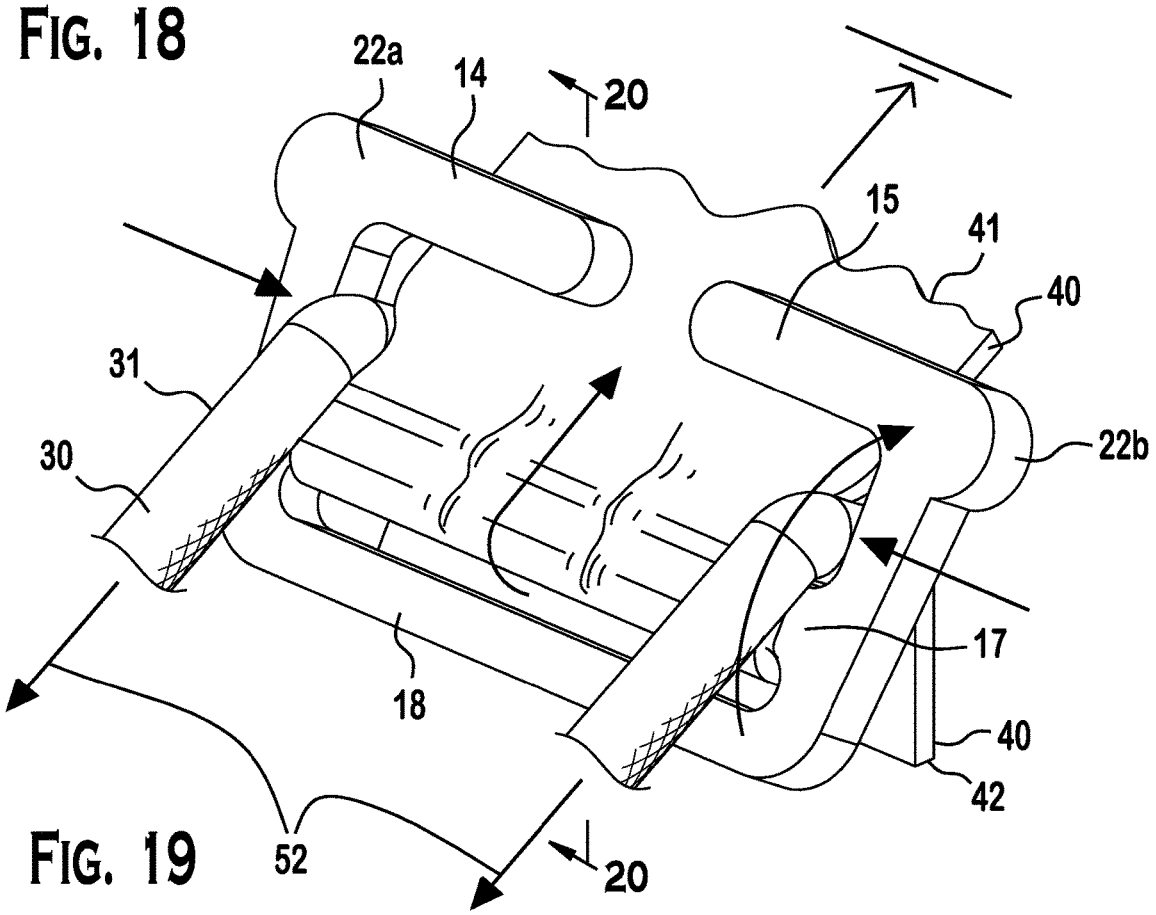
FIG. 19 is a perspective view of showing a 5th step in assembling the cord and webbing fastener, webbing, and cordage, i.e., showing increased tension forcing the cordage into a further rotation and locking the position of the cord and webbing fastener.
Figure 20:
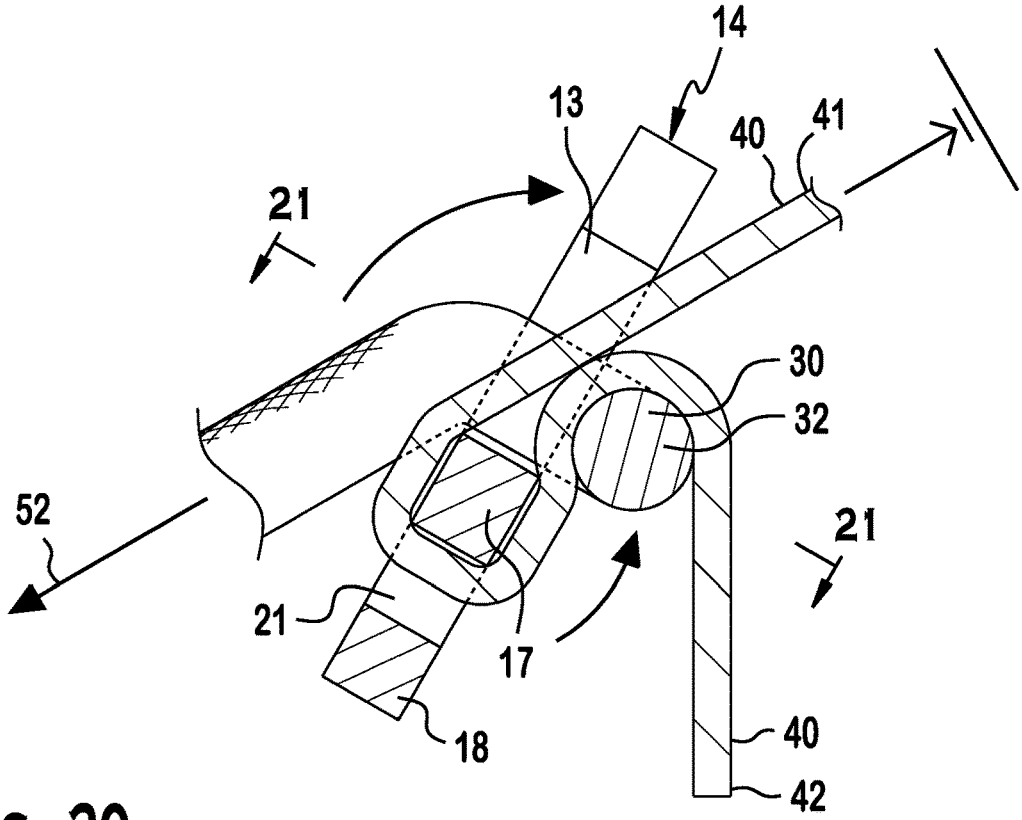
FIG. 20 is a cross section view along a line 20-20 of FIG. 19 showing the assembled cord and webbing fastener, webbing, and cordage thereof.
Figure 21:
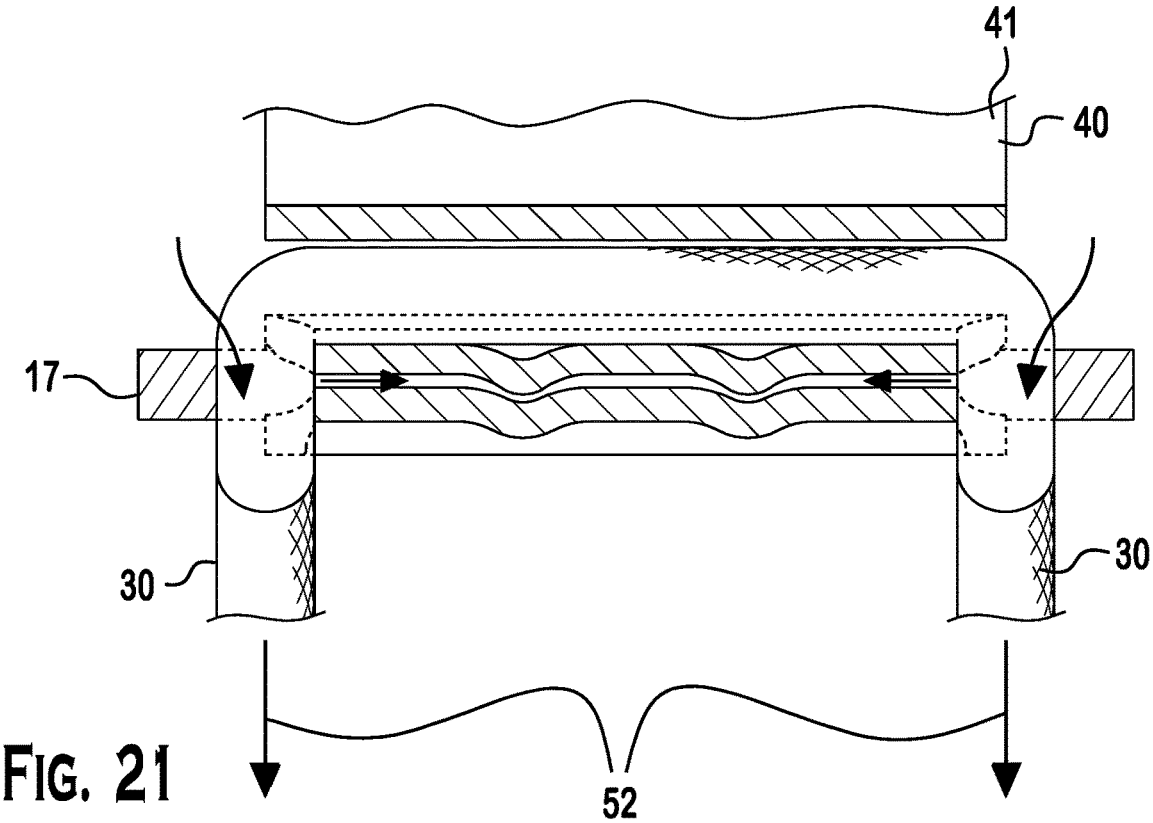
FIG. 21 is a view along a line 21-21 of FIG. 20 showing the assembled cord and webbing fastener, webbing, and cordage thereof, i.e., showing the webbing under increased tension from the cordage allowing the cord and webbing fastener to move along the webbing in the indicated direction.

In a fifth step as shown in FIGS. 19-20, additional increased tension placed on the cord 30 in the third direction 52 forces the cord loop to squeeze the webbing 40 laterally so that the fastener 11 can rotate back over the cord loop into a locking position where the first jaw 14 and the second jaw 15 are engaged with increased friction. In FIG. 21, the loop is shown squeezing the width of the webbing, allowing the fastener 11 to move "back on" the webbing.

Figure 22:
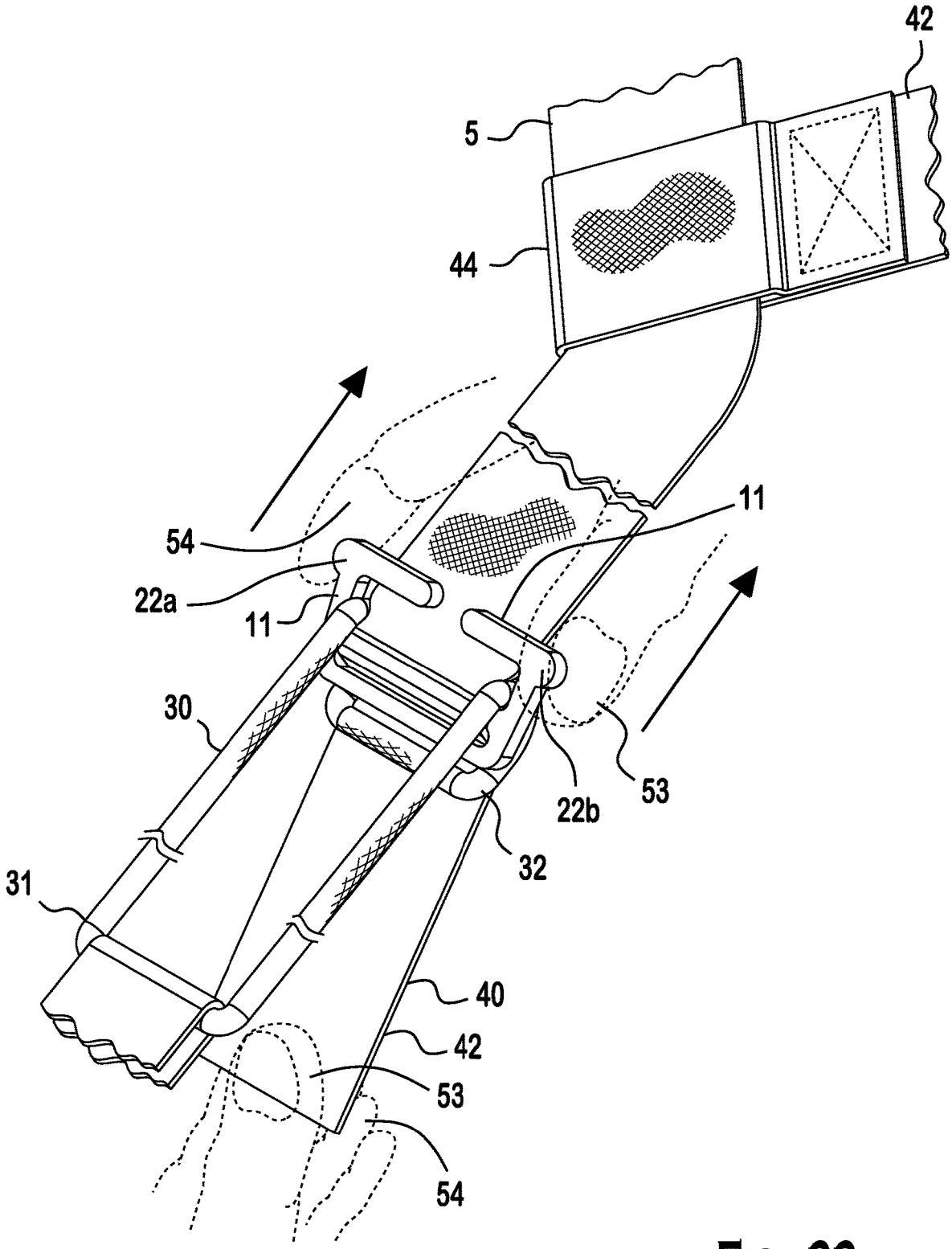
FIG. 22 is a perspective view of the assembled cord and webbing fastener, webbing, and cordage showing how the cord and webbing fastener is repositioned on the webbing.
Figure 23:
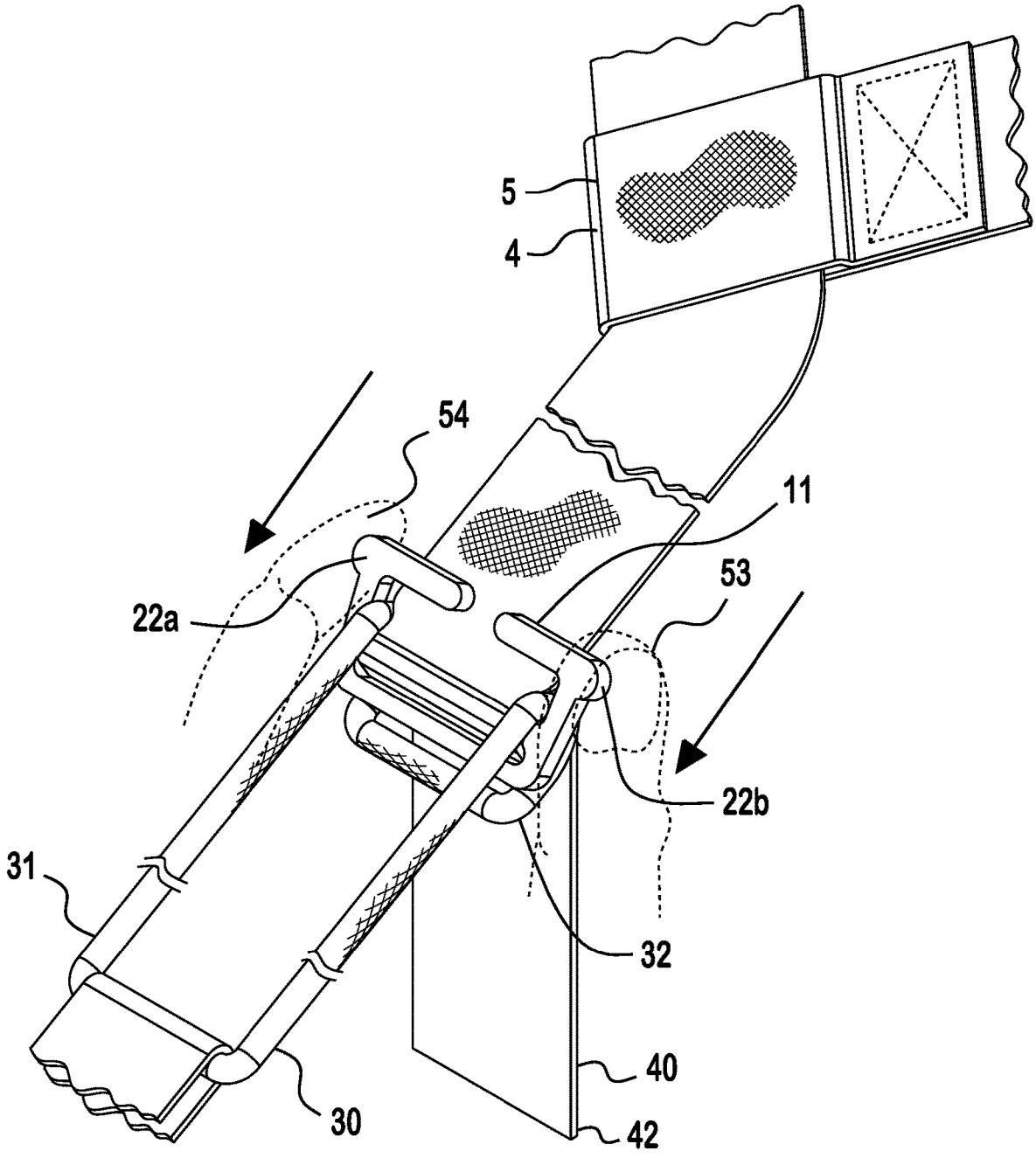
FIG. 23 is another perspective view of the assembled cord and webbing fastener, webbing, and cordage showing how the cord and webbing fastener is repositioned on the webbing.

FIG. 22 shows how the assembly may be easily adjusted to move the fastener 11 on the webbing 40 closer to the support. FIG. 23 shows how the assembly may be easily adjusted to move the fastener 11 on the webbing 40 further from the support using grip projections 22*a*, 22*b*.

Figure 24:
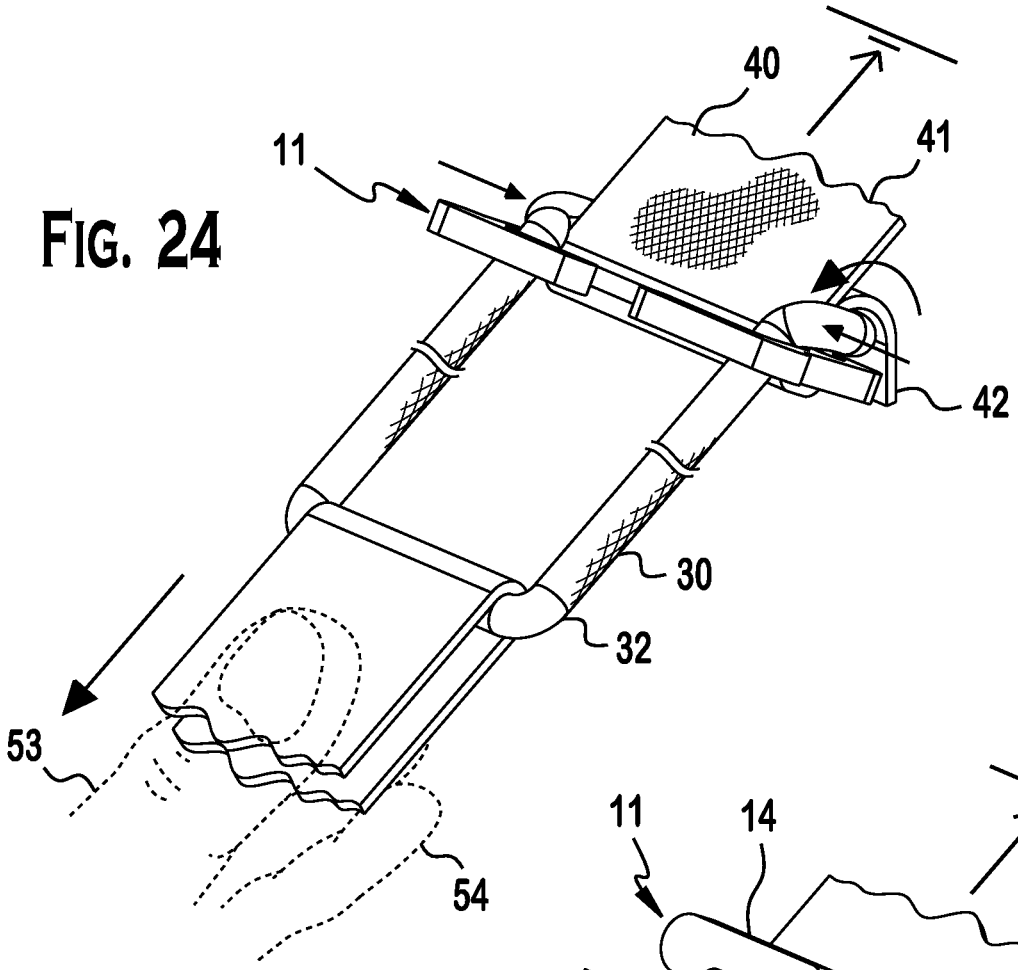
FIG. 24 is a perspective view of the assembled cord and webbing fastener, webbing, and cordage showing a first step (as in FIGS. 16-18) to re-engage the cordage following repositioning of the cord and webbing fastener on the webbing (as in FIG. 22 or FIG. 23)
Figure 25:
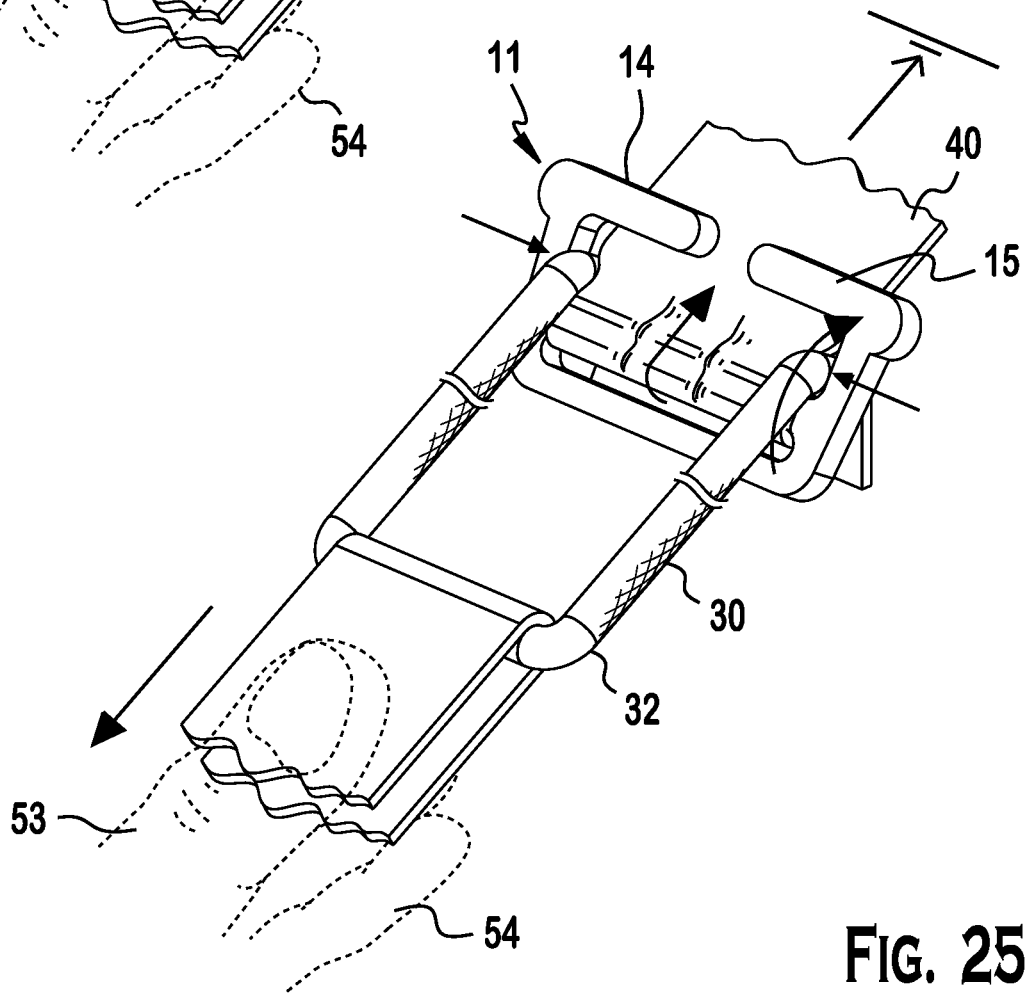
FIG. 25 is a is a perspective view of the assembled cord and webbing fastener, webbing, and cordage showing a second step (as in FIGS. 19-21) to re-engage the cordage following repositioning of the cord and webbing fastener on the webbing (as in FIG. 22 or FIG. 23).

FIG. 24 shows how the assembly may easily re-engage the webbing 40 using the initial tension as shown in FIGS. 16-18. FIG. 25 shows how the assembly may easily re-engage the webbing 40 using the increased tension as shown in FIGS. 19-21.

The first and second grip projections 22*a*, 22*b* are symmetrically disposed and facing in opposite directions from the central longitudinal axis of the fastener body in a common plane on opposing ends of the first jaw 14 and the second jaw 15 of the fastener 11. The first and second grip projections 22*a*, 22*b* are gripped, respectively, with thumb 53 and a finger 54 so that a force can be exerted in a direction to adjust the position of the loop of the webbing 40 to a desired distance from the support. Alternatively, a tool such as a set of pliers may be used to grip the first and second grip projections 22*a*, 22*b*. The grip projections 22*a*, 22*b* are illustrated to be smoothly rounded. Additional embodiments of the invention include grip projections that have ribs, gridding, or other texturing (not illustrated) that improve the gripping ability of fingers or plier-like tools.

To set the desired tension and distance between the fastener 11 and the supports 3, webbing 40 is pulled with sufficient force to bring the cord and webbing fastener assembly into a locked position. When the cord 30 is used to rotate the fastener 11, the cord 30 and webbing 40 are prevented from slipping through the jawed passageway and the elongated, oval-shaped passageway 21. In this "locked" position, the hammock 2 or other load is adjustably fixed in placed.

A kit comprising a plurality of fasteners, cords, and webbing is one embodiment of the invention. One embodiment of the kit includes fasteners pre-sewn onto lengths (for example, 8 and 15 feet) of polyester webbing straps. Various types of cords (i.e., continuous loops, shock cords, etc.) may be included in a kit.

While the invention has been described in detail and with reference to specific embodiments, one of ordinary skill in the art would appreciate that the described embodiments are illustrative, and that various changes and modifications can be made without departing from the scope of the invention

What is claimed is:

1. A hammock end fastener assembly comprising a continuous looped cord; a webbing; and a fastener, the fastener having: a bottom bar positioned along a distal end thereof; a mid-bar positioned substantially parallel to the bottom bar; a first jaw and a second jaw positioned along a proximal end thereof and substantially parallel to the mid-bar; a first joining element connecting a first end of the first jaw, a first end of the mid-bar, and a first end of the bottom bar; and a second joining element connecting a first end of the second jaw, a second end of the mid-bar, and a second end of the bottom bar provide: an elongated, oval-shaped passageway in the distal end extending through the cord and webbing fastener from lateral sides thereof and between the mid-bar and the bottom bar and sized to receive a flexible webbing; and a jawed passageway in the proximal end extending through the cord and webbing fastener from lateral sides thereof and between the generally parallel mid-bar and the first jaw and the second jaw, the jawed passageway having a gap between the second end of the first jaw and the first end of the second jaw; wherein the continuous looped cord is positioned around the webbing on the side of the fastener adjacent to first and second ends of the webbing and on the opposite side of the fastener from the loop of webbing about the mid-bar, and then the continuous looped cord is positioned through the gap and into the jawed passageway such that the first jaw and the second jaw engage the continuous looped cord.

2. The cord and webbing fastener of claim 1, wherein the jawed passageway is sized to receive webbing.

3. The cord and webbing fastener of claim 1, wherein webbing is threaded through the jawed passageway in a first direction, looped around the mid-bar, and then threaded in a second direction through the elongated, oval-shaped passageway.

4. The cord and webbing fastener of claim 1, wherein the proximal end further includes a first grip projection located at the intersection of the first joining element with the first end of the first jaw and a second grip projection located at the intersection of the second joining element with the second end of the second jaw.

5. The cord and webbing fastener of claim 4, wherein the first grip projection and the second grip projection are symmetrically disposed and facing in opposite directions from the central longitudinal axis of the cord and webbing fastener in the common plane.

6. The cord and webbing fastener of claim 1, wherein the fastener body is titanium.

7. The cord and webbing fastener of claim 1, wherein the fastener body has beveled edges.

8. A cord and webbing fastener assembly comprising a cord; a webbing; a fastener having: a bottom bar positioned along a distal end thereof; a mid-bar positioned substantially parallel to the bottom bar; a first jaw and a second jaw positioned along a proximal end thereof and substantially parallel to the mid-bar; a first joining element connecting a first end of the first jaw, a first end of the mid-bar, and a first end of the bottom bar; and a second joining element connecting a first end of the second jaw, a second end of the mid-bar, and a second end of the bottom bar;

an elongated, oval-shaped passageway in the distal end extending through the cord and webbing fastener from lateral sides thereof and between the mid-bar and the bottom bar and sized to receive a flexible webbing;

a jawed passageway in the proximal end extending through the cord and webbing fastener from lateral sides thereof and between the generally parallel mid-bar and the first jaw and the second jaw, the jawed passageway having a gap between the second end of the first jaw and the first end of the second jaw;

the webbing sized to thread linearly through the elongated, oval-shaped passageway and the jawed passageway; and the cord sized to be positioned around the threaded webbing and to be positioned within the jawed passageway.

9. The cord and webbing fastener of claim 8, wherein the jawed passageway is sized to receive webbing.

10. The cord and webbing fastener of claim 8, wherein webbing is threaded through the jawed passageway in a first direction, looped around the mid-bar, and then threaded in a second direction through the elongated, oval-shaped passageway.

11. The cord and webbing fastener of claim 8, wherein the proximal end further includes a first grip projection located at the intersection of the first joining element with the first end of the first jaw and a second grip projection located at the intersection of the second joining element with the second end of the second jaw.

12. The cord and webbing fastener of claim 11, wherein the first grip projection and the second grip projection are symmetrically disposed and facing in opposite directions from the central longitudinal axis of the cord and webbing fastener in the common plane.

13. The cord and webbing fastener of claim 8, wherein the fastener body is titanium.

14. The cord and webbing fastener of claim 8, wherein the fastener body has beveled edges.

* * * * *